US007653326B2

(12) United States Patent
Ozawa

(10) Patent No.: US 7,653,326 B2
(45) Date of Patent: Jan. 26, 2010

(54) IMAGE FORMATION DEVICE WITH BELT MOUNTED PIVOTING COVER

(75) Inventor: Toru Ozawa, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/265,269

(22) Filed: Nov. 3, 2005

(65) Prior Publication Data

US 2006/0291897 A1 Dec. 28, 2006

(30) Foreign Application Priority Data

Jun. 24, 2005 (JP) ..... 2005-184468

(51) Int. Cl.
*G03G 15/00* (2006.01)

(52) U.S. Cl. ..... 399/110; 399/124

(58) Field of Classification Search ..... 399/114, 399/117, 124, 121, 110, 125
See application file for complete search history.

(56) References Cited

U.S. PATENT DOCUMENTS 7,349,648 B2 * 3/2008 Rennick et al. ..... 399/110
2003/0142994 A1 7/2003 Harada et al.
2003/0156856 A1 * 8/2003 Arimitsu et al. ..... 399/114
2004/0126136 A1 * 7/2004 Toba et al. ..... 399/114
2004/0208670 A1 10/2004 Abe
2006/0147225 A1 7/2006 Harada et al.

FOREIGN PATENT DOCUMENTS

JP 2003-208074 A 7/2003
JP 2003-208075 A 7/2003
JP 2003-241616 A 8/2003

* cited by examiner

*Primary Examiner*—David M Gray
*Assistant Examiner*—Bryan P Ready
(74) *Attorney, Agent, or Firm*—Sughrue Mion, PLLC

(57) ABSTRACT

A plurality of process cartridges are provided at a device main body. The process cartridges are arranged in tandem in a vertical direction, and are each mountable/removable by being withdrawn in a horizontal direction. A transport belt is disposed near side portions of the process cartridges. The transport belt transports paper between the transport belt and each of the process cartridges. A cover covers the side portions of the process cartridges and is axially supported at the device main body, below the process cartridges, to be swingable. The cover is attached to be capable of opening and closing a process cartridge side portions side of the device main body. The belt is mounted at the cover so as to be disposed between the process cartridges and the cover, and operates integrally with the cover.

17 Claims, 3 Drawing Sheets

IMAGE FORMATION DEVICE WITH BELT MOUNTED PIVOTING COVER

CROSS-REFERENCE TO RELATED APPLICATION

This application claims priority under 35 USC 119 from Japanese Patent Application No. 2005-184468, the disclosure of which is incorporated by reference herein.

BACKGROUND OF THE INVENTION

1. Field of the Invention

The present invention relates to an image formation device which forms an image on a recording medium.

2. Description of the Related Art

An image formation device for forming an image on a recording medium is known which is provided with a plurality of process cartridges, which are provided at a main body of the device to be mountable and removable in a lateral direction (horizontal direction), and which are arranged in tandem (see, for example, Japanese Patent Application Laid-Open (JP-A) No. 2003-241616). A belt body, which is disposed at a lateral direction side of these process cartridges (a side of side portions of the process cartridges), is swung to open up the lateral direction (side portions) side of the process cartridges, and the process cartridges are mounted/removed.

However, in JP-A No. 2003-241616, the belt body is axially supported at the device main body. Therefore, when the belt body is swung and the lateral direction side of the process cartridges is opened up, the belt body is not greatly separated from the process cartridges. Hence, the belt body is an obstacle at times of mounting/removal, particularly of a lowest of the process cartridges. Moreover, at times of mounting/removal of the process cartridges, the belt body may be soiled by toner which leaks from the process cartridges.

SUMMARY OF THE INVENTION

In consideration of the circumstances described above, the present invention will provide an image formation device in which a belt body does not become an obstacle at times of mounting/removal of process cartridges.

A first aspect of the present invention is an image formation device which includes: a device main body; a plurality of process cartridges, which are provided at a device main body to be mountable and removable in a lateral direction and which are arranged in tandem; a belt body disposed at a lateral direction side of the plurality of process cartridges; and a cover body which is axially supported downward of the plurality of process cartridges, the cover body being capable of opening up the lateral direction side of the plurality of process cartridges, wherein the belt body is mounted at the cover body and moves integrally with the cover body.

A second aspect of the present invention is an image formation device which includes: a device main body; a plurality of process cartridges, which are arranged in tandem in a vertical direction and which are each provided at a device main body to be removable by being drawn out in a horizontal direction; a belt body disposed near side portions of the plurality of process cartridges; and a cover body which covers the side portions of the plurality of process cartridges, wherein the cover body is axially supported at the device main body, downward of the plurality of process cartridges, to be swingable, the belt body is mounted at the cover body so as to be disposed between the plurality of process cartridges and the cover body, and the belt body swings integrally with the cover body.

A third aspect of the present invention is an image formation device which includes: a device main body; a plurality of process cartridges, which are arranged in tandem in a vertical direction and which are each provided at a device main body to be removable by being drawn out in a horizontal direction; a belt body disposed near side portions of the plurality of process cartridges, the belt body transporting paper between the belt body and each of the plurality of process cartridges; and a cover body which covers the side portions of the plurality of process cartridges, wherein the cover body is axially supported at the device main body, downward of the plurality of process cartridges, to be swingable, for opening and closing a side of the device main body at the side portions, the belt body is mounted at the cover body so as to be disposed between the plurality of process cartridges and the cover body, and the belt body operates to open and close integrally with the cover body.

In these structures, the belt body which is disposed at the lateral direction (side portions) side of the process cartridges is axially supported downward of the process cartridges, is attached to the cover body which is capable of exposing the lateral direction (side portions) side of the process cartridges, and moves integrally with the cover body.

Therefore, when the cover body opens up the lateral direction side of the process cartridges, the belt body can be moved further from the process cartridges than in a case in which a belt body is axially supported at a side of a device main body, and the belt body will not be an obstacle at times of mounting/removal of the process cartridges.

Note that the lateral direction referred to herein is a lateral direction (horizontal direction) with respect to an upward direction and a downward direction (vertical directions) of the image formation device, may of course be to either of two sides with respect to a front face of the image formation device, or may be to a front face side, a rear face side or the like of the image formation device.

BRIEF DESCRIPTION OF THE DRAWINGS

An embodiment of the present invention will be described in detail based on the following figures, wherein.

DETAILED DESCRIPTION OF THE INVENTION

Herebelow, an example of an embodiment relating to an image formation device of the present invention will be described in accordance with the drawings.

First, overall structure of an image formation device 10 of the present embodiment will be described.

Figure 1:
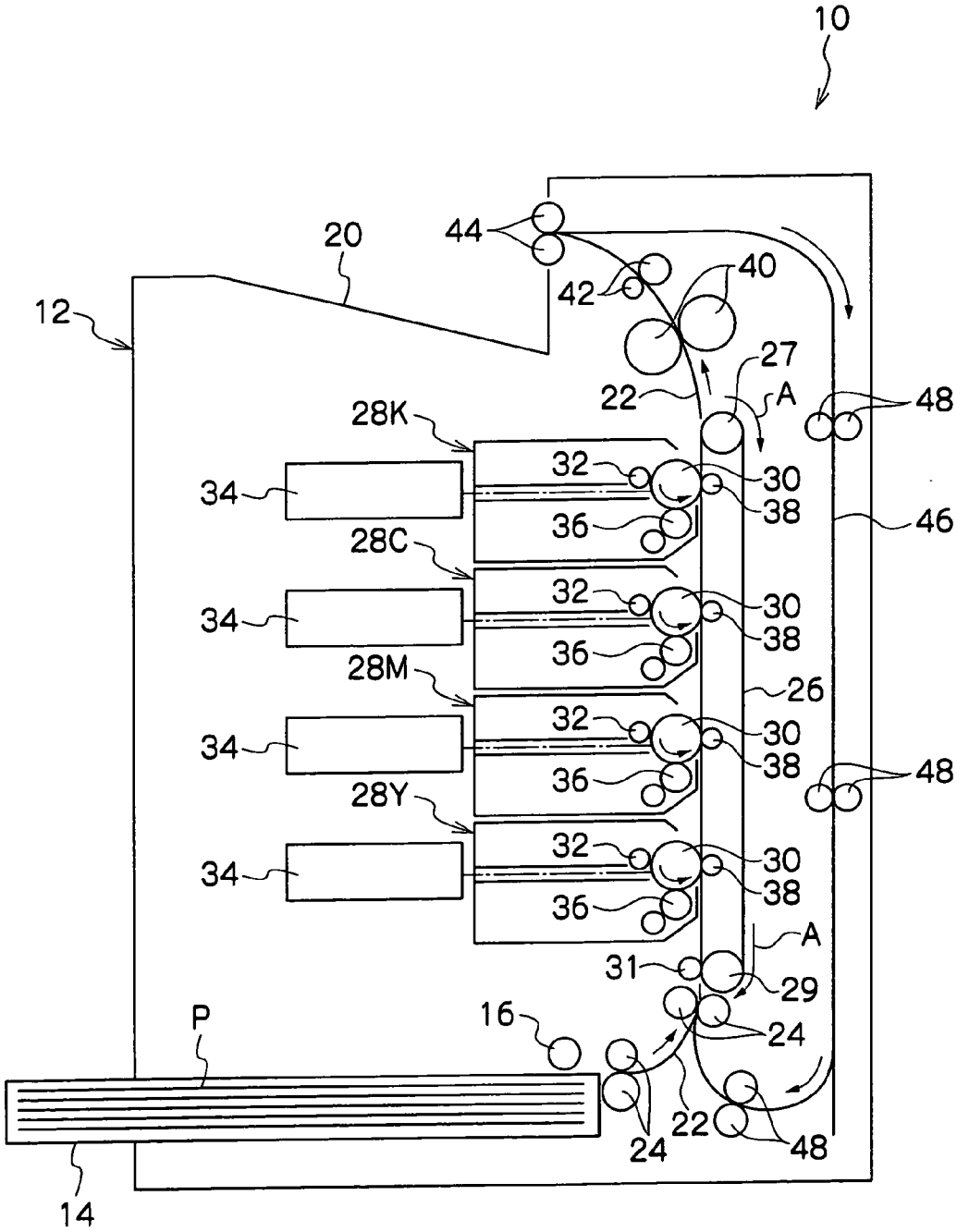
FIG. 1 is a side view of an image formation device relating to the embodiment of the present invention.
Figure 2:
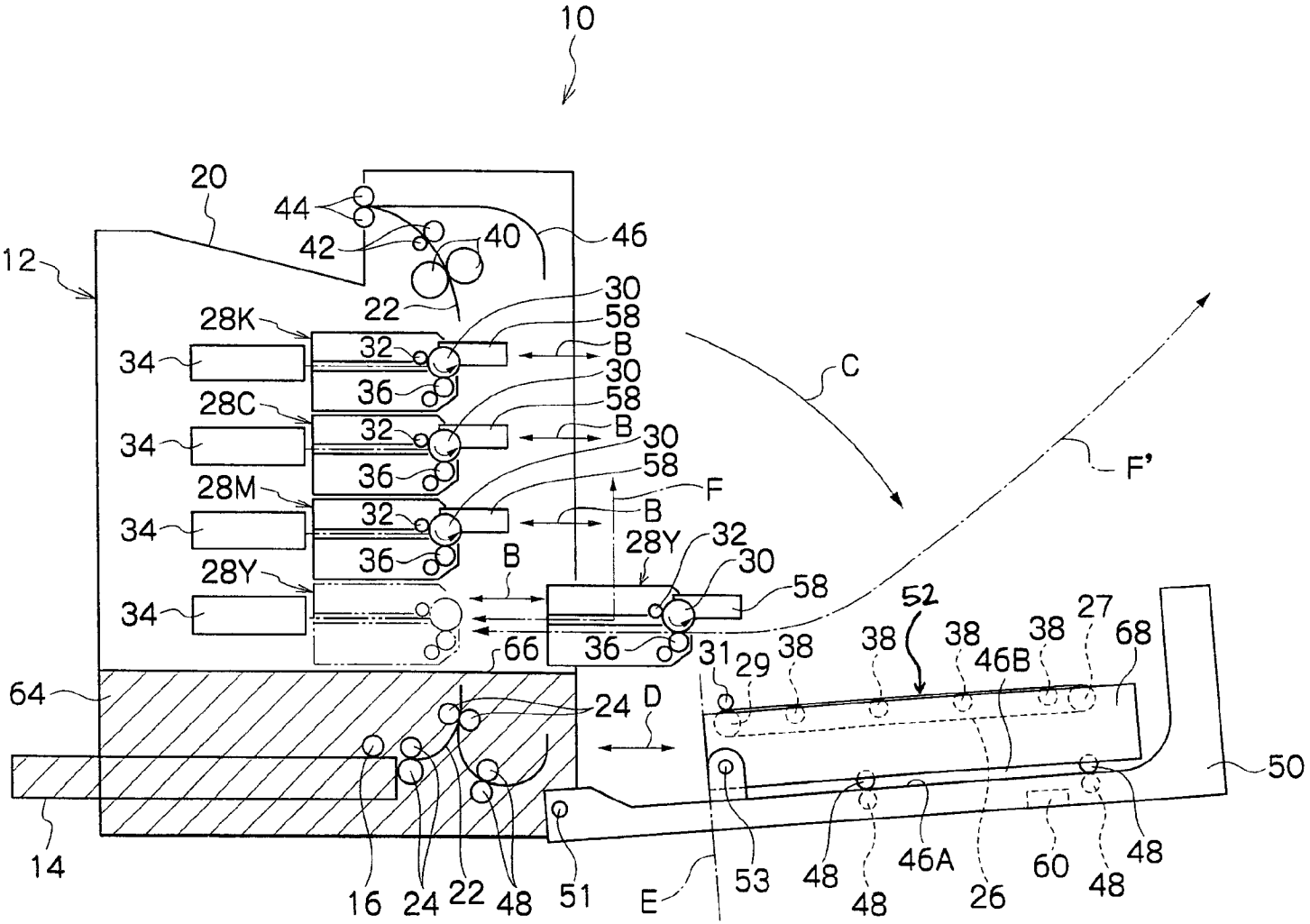
FIG. 2 is a side view of the image formation device relating to the present embodiment, of a state in which a cover body is opened.

As shown in FIGS. 1 and 2, the image formation device 10 of the present embodiment is provided with a device main body 12. A paper supply section 64 (the shaded portion in FIG. 2) is provided at a lower portion of the device main body 12. The paper supply section 64 supplies paper P (a recording medium) to an image formation section (between process cartridges 28Y, 28M, 28C and 28K and a transport belt 26, which are described later).

The paper supply section 64 is formed in a box shape, being a paper supply cassette which can be mounted/removed in a direction D. A paper tray 14 is disposed at the paper supply section 64. The paper P is stacked in a sheaf at the paper tray 14.

A feed roller 16 is disposed at an upper portion of a leading end side (the right end side in FIGS. 1 and 2) of the paper tray 14. The feed roller 16 presses against the leading end side of an upper face of the paper P and takes out the paper P from inside the paper tray 14.

A first transport path 22 is also provided. The first transport path 22 extends from a leading end portion of the paper tray 14, curves gently, and extends substantially vertically upward at a front side of the device (the right side in FIGS. 1 and 2).

A plurality (for example, two) of transport roller pairs 24 and the transport belt 26 (belt body), which has an endless form, are arranged along the first transport path 22 in this order from a paper transport direction upstream side. The transport roller pairs 24 nip and convey the paper P. The transport belt 26 electrostatically attracts and transports paper P at which an image is to be formed. By being disposed along the first transport path 22, the transport belt 26 forms a portion of a path face at one side of the first transport path 22.

This transport belt 26 spans between a spanning roller 27 which is disposed upward and a spanning roller 29 which is disposed downward. One of the spanning roller 27 and the spanning roller 29 is driven to rotate, as a result of which the transport belt 26 turns in direction A.

At a paper transport direction upstream side of the transport belt 26, a charging roller 31 is provided adjacent to the transport belt 26. The charging roller 31 electrostatically charges the surface of the transport belt 26, and presses paper P that is to be electrostatically adhered to the transport belt 26 against the transport belt 26.

The plurality of process cartridges 28Y, 28M, 28C and 28K are arranged in tandem along the first transport path 22 in a substantially vertical direction in the device main body 12. The process cartridges 28Y, 28M, 28C and 28K oppose the transport belt 26 to sandwich the first transport path 22 therebetween, and correspond to the respective colors yellow, magenta, cyan and black.

As shown in FIG. 2, these process cartridges 28Y, 28M, 28C and 28K are mountable and removable in a lateral direction (the direction of arrow B), which is to say a horizontal direction. At each of the process cartridges 28Y, 28M, 28C and 28K, grips 58 are provided at each of two width direction end portions. The grips 58 are held at times of mounting/removal. Note that the grips 58 are not illustrated in FIG. 1.

Each of the process cartridges 28Y, 28M, 28C and 28K is provided with a respective photosensitive drum 30, which rotates in a predetermined direction (anti-clockwise in FIGS. 1 and 2).

Around each photosensitive drum 30, a charging roller 32, an exposure device 34 and a developing roller 36 are provided in this order from an upstream side in a direction of rotation of the photosensitive drum 30. The charging roller 32 electrostatically charges a surface of the photosensitive drum 30. The exposure device 34 exposes the photosensitive drum 30 to form a latent image on the photosensitive drum 30. The developing roller 36 adheres toner of the respective color to the latent image formed on the photosensitive drum 30, to develop the latent image.

Meanwhile, transfer devices 38 are provided at an inner peripheral side of the transport belt 26. The transfer devices 38 oppose the respective photosensitive drums 30 and transfer the toner images formed on the photosensitive drums 30 onto the paper P at predetermined transfer positions.

A fixing apparatus 40, a transport roller pair 42 and an ejection roller pair 44 are disposed at a paper transport direction downstream side relative to the transport belt 26. The fixing apparatus 40 fixes the transferred toner images to the paper P. The transport roller pair 42 nips and transports the paper P. The ejection roller pair 44 ejects the paper P to an ejection tray 20.

A second transport path 46 is provided for inverting the paper P at one face of which an image has been formed and feeding the paper P back to the first transport path 22 again. The second transport path 46 opposes the first transport path 22 with the transport belt 26 sandwiched therebetween.

A plurality (for example, three) of transport roller pairs 48 are provided at the second transport path 46. The transport roller pairs 48 nip and transport the paper P downward. When images are to be formed at both faces, the paper P that has had an image formed on one face thereof is switchbacked by the ejection roller pair 44 and guided to the second transport path 46, is transported downward by the plurality of transport roller pairs 48, and is fed back to the first transport path 22.

Next, an image formation operation of the present embodiment, for forming an image on the paper P, will be described.

In the image formation device 10 of the present embodiment, when an image is to be formed on one face of the paper P, the paper P is taken out from the paper tray 14, is transported upward along the first transport path 22 by the plurality of transport roller pairs 24, and is fed to the transport belt 26. The paper P that has been fed to the transport belt 26 is pushed against the transport belt 26 by the charging roller 31 and electrostatically adhered to the charged transport belt 26. This paper P is transported upward and fed sequentially to the predetermined transfer positions corresponding to the colors yellow, magenta, cyan and black.

The paper P that has been fed to a predetermined transfer position has the toner image of the respective color, which has been formed on the photosensitive drum 30, transferred thereto by the transfer device 38. Thus, a full-color image is formed on the paper P. The paper P is further transported to the fixing apparatus 40, the transferred toner image is fixed by the fixing apparatus 40, and the paper P is ejected to the ejection tray 20 by the ejection roller pair 44.

In a case in which images are to be formed on both faces of the paper P, after a toner image has been fixed by the fixing apparatus 40 to form an image at one face, the paper P which has had the image formed at one face is switchbacked by the ejection roller pair 44, and is reversed and fed into the second transport path 46. The paper P is fed from the second transport path 46 into the first transport path 22 again, and an image is formed at another face in the same manner as described above. Thus, images are formed at both sides of the paper P. As described above, a series of the image formation operation is performed.

Next, a structure which opens up the lateral direction (side portions) side of the process cartridges 28Y, 28M, 28C and 28K will be described.

As shown in FIG. 2, an 'L'-shaped cover body 50 is axially supported by a support shaft 51 at a lower portion of the paper supply section 64 to be capable of swinging. The cover body 50 is provided to be capable of opening up the lateral direction side of the process cartridges 28Y, 28M, 28C and 28K by swinging down from the device main body 12 to outside the device (i.e., in the direction of arrow C in FIG. 2).

At an inner peripheral face of the cover body 50, one path face 46A of the second transport path 46 is formed, and one of each of the transport roller pairs 48 is provided. At an outer peripheral face of the cover body 50, a grip 60 is provided, which is held when the cover body 50 is to be swung.

Figure 3:
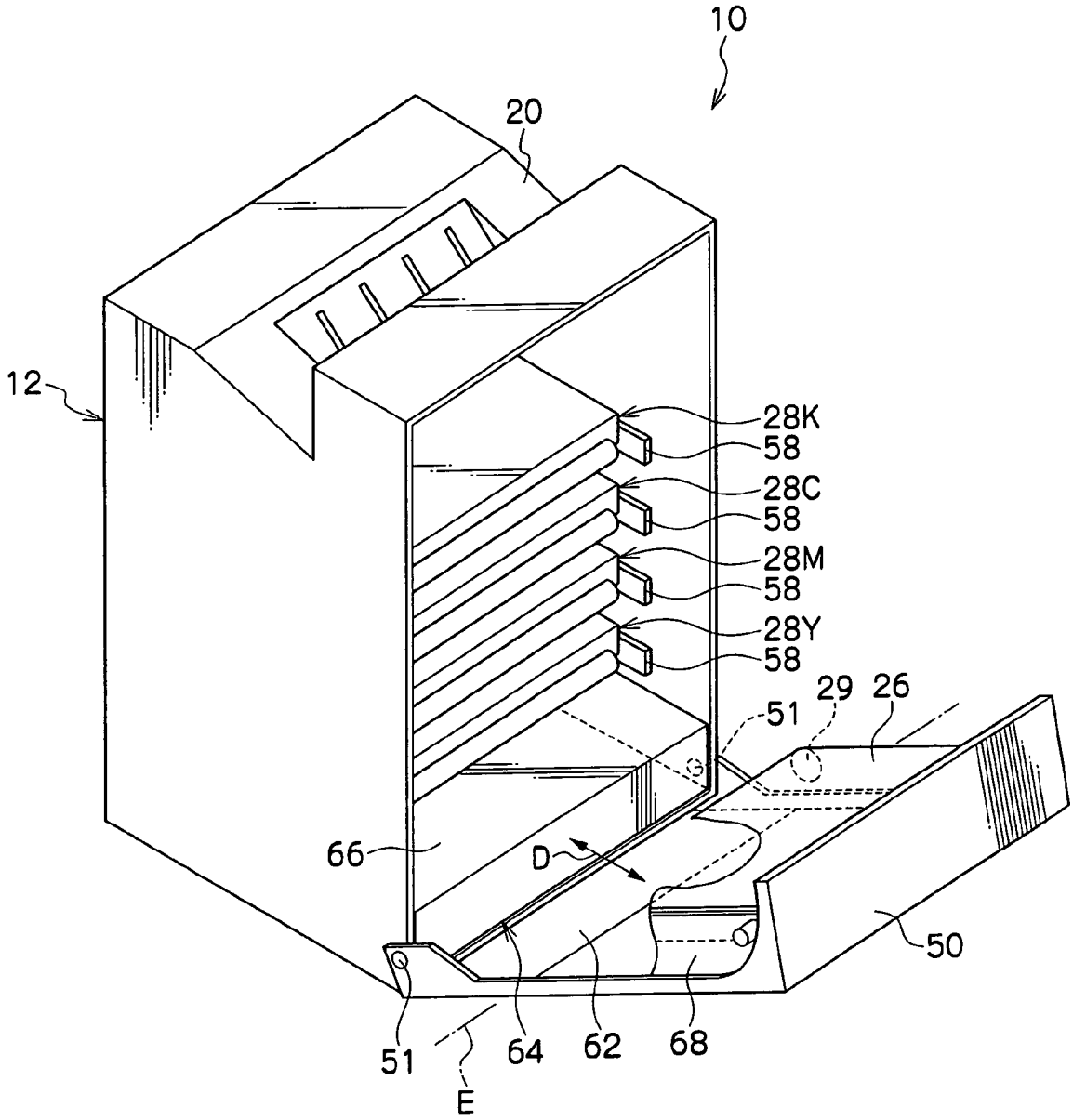
FIG. 3 is a perspective view of the image formation device relating to the present embodiment, of the state in which the cover body is opened.

As shown in FIG. 3, an opening portion 62 is provided at a lower portion of the cover body 50. Thus, the cover body 50 is formed in a gate form.

The paper supply section 64 (the shaded portion in FIG. 2), which is the paper supply cassette, is made to be mountable/removable in the direction of arrow D through the opening portion 62.

A guide portion 66 is formed at an upper face of the paper supply section 64. The lowest process cartridge 28Y can be placed on the guide portion 66. The guide portion 66 guides the process cartridge 28Y which has been placed thereon to an installation position in the device main body 12.

A transport belt unit 52, which includes the transport belt 26, is attached to an upper side of the cover body 50 relative to the opening portion 62 by a support shaft 53. The transport belt unit 52 is structured to swing down integrally with the cover body 50.

The transport belt 26 is provided at a side of the transport belt unit 52 which opposes the process cartridges 28Y, 28M, 28C and 28K (the upper side in FIG. 2). At a side of the transport belt unit 52 which opposes the cover body 50 (the lower side in FIG. 2), another path face 46B of the second transport path 46 is formed, and the other of each of the transport roller pairs 48 is provided.

The others of the transport roller pairs 48 and the spanning rollers 27 and 29, between which the transport belt 26 spans, are axially supported at a pair of side plates 68 of the transport belt unit 52, which are provided at two axial direction end portions of each of the others of the transport roller pairs 48 and the spanning rollers 27 and 29. A lower end of the transport belt 26 is provided so as to be disposed directly above an upper end of the opening portion 62 (see the broken line E in FIGS. 2 and 3). Furthermore, the charging roller 31 is provided integrally with the transport belt 26 and is structured so as to swing integrally with the cover body 50.

The charging roller 31 and the transport belt 26 are structured so as to move to a position lateral to the paper supply section 64 when the cover body 50 swings and opens up the lateral direction side of the process cartridges 28Y, 28M, 28C and 28K.

That is, the present embodiment has a structure in which, when the cover body 50 opens the lateral direction side of the process cartridges 28Y, 28M, 28C and 28K, the charging roller 31 and the transport belt 26 move to a position which is removed from a mounting/removal path of the lowest process cartridge 28Y.

Herein, a mounting/removal path means a path along which one of the process cartridges 28Y, 28M, 28C and 28K proceeds when being installed at or taken out from the device main body 12. When the process cartridge 28Y, 28M, 28C or 28K has been unmounted from the device main body 12, the process cartridge 28Y, 28M, 28C or 28K can be extracted by being lifted upward. Thus, in the present embodiment, for example, a path shown by the broken line F is a mounting/removal path. However, in order to make ease of extraction of the process cartridge 28Y, 28M, 28C or 28K more excellent, a condition in which it is possible to move an extraction direction trailing end side of the process cartridge 28Y, 28M, 28C or 28K in the lateral direction (horizontal direction) until completely disengaged from the device main body 12, a condition in which, from a vicinity at which the extraction direction trailing end side of the process cartridge 28Y, 28M, 28C or 28K is substantially disengaged from the device main body 12, the process cartridge 28Y, 28M, 28C or 28K is extracted along a path which is a gentle parabola rather than being lifted vertically upward, or the like is preferable, as with, for example, the path shown by the broken line F'.

Next, operations of the above-described embodiment will be described.

In the present embodiment, the transport belt 26 which is disposed at the lateral direction (side portions) side of the process cartridges 28Y, 28M, 28C and 28K is mounted at the cover body 50, which is axially supported at the lower portion of the paper supply section 64 and is capable of opening up the lateral direction side of the process cartridges 28Y, 28M, 28C and 28K. Further, when the cover body 50 has opened up the lateral direction side of the process cartridges 28Y, 28M, 28C and 28K, the charging roller 31 and the transport belt 26 are removed from the mounting/removal path of the lowest process cartridge 28Y.

Hence, because the charging roller 31 and the transport belt 26 are removed from the mounting/removal path of the lowest process cartridge 28Y, the charging roller 31 and the transport belt 26 will not be obstacles when the lowest process cartridge 28Y is being mounted or removed.

Further, because the transport belt 26 is mounted at the cover body 50, in comparison with a case in which the transport belt 26 is axially supported at the device main body 12 instead, the transport belt 26 can be moved further away from the process cartridges 28Y, 28M, 28C and 28K, and the transport belt 26 is more unlikely to become an obstacle when the process cartridges 28Y, 28M, 28C and 28K are being mounted/removed.

Further still, because the cover body 50 is axially supported at the lower portion of the paper supply section 64, when the cover body 50 opens up in the lateral direction, the transport belt 26 mounted at the cover body 50 can be separated even further, and it is possible to mount/remove, in particular, the lowest process cartridge 28Y excellently.

If the transport belt 26 were to be axially supported at a lower portion of the device main body 12 instead, and were to be moved far from the process cartridges 28Y, 28M, 28C and 28K, it would be necessary to extend a lower portion of the device main body 12 (a portion below the process cartridges 28Y, 28M, 28C and 28K) downward, height of the device would be increased, and the device as a whole would be increased in size. In contrast, with the present embodiment, because the transport belt 26 is not axially supported at the lower portion of the device main body 12, it is possible to move the transport belt 26 far from the process cartridges 28Y, 28M, 28C and 28K without increasing the device height.

Further again, in the present embodiment, the guide portion 66 is formed at the upper face of the paper supply section 64. Therefore, mounting characteristics of the lowest process cartridge 28Y can be improved, even for a case in which a space for mounting/removal is constricted and, at a time of mounting of the lowest process cartridge 28Y, it is difficult for a user to see a mounting position of the lowest process cartridge 28Y from a standing position.

Because this guide portion 66 is formed at the upper face of the paper supply section 64 (the paper supply cassette), there is no need for this guide portion 66 to be provided separately as a particular guide portion. In addition, because the guide portion 66 utilizes a portion of the paper supply section 64 which is provided downward of the basic image formation device 10, as well as avoiding the addition of extra components, it is possible to restrain height of the device and to reduce size of the device.

Further yet, because the transport belt 26 is disposed just above the upper end of the opening portion 62 (see the broken line E), a limit of possible heights of the device can be lowered.

Now, although the above embodiment has been described with a transport belt serving as a belt body, the belt body of the present invention is not limited thus, and could be an intermediate transfer belt, which performs a primary transfer of toner images of the respective colors from the photosensitive drums 30 of the process cartridges 28Y, 28M, 28C and 28K and performs a secondary transfer of the primary-transferred toner images to paper.

Furthermore, although the embodiment described above is structured such that the charging roller 31 and the transport belt 26 move to the level of the paper supply section 64 when the cover body 50 opens up the lateral direction side of the process cartridges 28Y, 28M, 28C and 28K, the spirit of the present invention is that it is not necessary for the charging roller 31 and transport belt 26 to be wholly removed to the level of the paper supply section 64, but that it is sufficient for the charging roller 31 and transport belt 26 to be removed from the mounting/removal path of the lowest process cartridge 28Y (see the broken line F).

Although the present invention has been explained by reference to the particular embodiment described above, interpretation of the present invention should not be limited to the above example. That is, a first aspect of the present invention is provided by an image formation device which includes: a plurality of process cartridges, which are provided at a device main body to be mountable and removable in a lateral direction and which are arranged in tandem; a belt body disposed at a lateral direction side of the plurality of process cartridges; and a cover body which is axially supported downward of the plurality of process cartridges, the cover body being capable of opening up the lateral direction side of the plurality of process cartridges, and the belt body being mounted at the cover body and moving integrally with the cover body.

The image formation device of the above-described aspect of the present invention may further include a paper supply portion provided downward of the process cartridges, with the cover body being axially supported at a lower portion of the paper supply portion.

In this structure, a paper supply cassette may be mountably and removably provided at the paper supply section.

Furthermore, in this structure, an opening portion through which the paper supply cassette can be passed may be formed at the cover body, with a lower end of the belt body being disposed upward of (above) the opening portion.

Further, in the above-described aspect of the present invention, a guide portion at which a lowest process cartridge can be placed may be provided, the guide portion guiding the process cartridge that has been placed thereat to a mounting position in the device main body.

In this structure, the guide portion may be formed at the upper face of a paper supply portion which is provided downward of the process cartridges.

Further again, the above-described aspect of the present invention may be structured such that, when the cover body opens up the lateral direction side of the process cartridges, the belt body is removed from a path of mounting and removal of the lowest process cartridge.

Further still, in the above-described aspect of the present invention, the belt body may include a transport belt which electrostatically attracts and transports paper, and a charging roller which electrostatically charges the transport belt may be provided at the transport belt, with, when the cover body opens up the lateral direction side of the process cartridges, the charging roller being removed from the path of mounting and removal of the lowest process cartridge.

Because the present invention has the constitution described above, the belt body will not be an obstacle at times of mounting/removal of process cartridges.

What is claimed is:

1. An image formation device comprising:

a device main body;

a plurality of process cartridges, which are provided at a device main body to be mountable and removable in a lateral direction and which are arranged in tandem;

a paper supply portion provided downward of the plurality of process cartridges;

a belt body disposed at a lateral direction side of the plurality of process cartridges; and a roller which is provided on the belt body and urges, toward the belt body, paper which has been fed to the belt body from the paper supply portion;

a cover body which is axially supported at a position below a supply tray of the paper supply portion, from which paper is conveyed, the cover body being capable of opening up the lateral direction side of the plurality of process cartridges, wherein the belt body is mounted at the cover body and moves integrally with the cover body;

wherein, when the cover body opens up the lateral direction side of the process cartridges, the belt body is removed from a path of mounting and removal of a lowest process cartridge of the plurality of process cartridges, and a fixed guide portion at which a lowest process cartridge of the plurality of process cartridges is placed guides the lowest process cartridge to a mounting operation position in the device main body.

2. The image formation device of claim 1, wherein a paper supply cassette is mountably and removably provided at the paper supply portion.

3. The image formation device of claim 2, wherein an opening portion through which the paper supply cassette can be passed is formed at the cover body, and a lower end of the belt body is disposed upward of the opening portion.

4. The image formation device of claim 1, wherein the guide portion is formed at an upper face of the paper supply portion.

5. The image formation device of claim 1, wherein the belt body comprises a transport belt which electrostatically attracts and transports paper, a charging roller which electrostatically charges the transport belt is provided at the belt body, and, when the cover body opens up the lateral direction side of the process cartridges, the charging roller is removed from a path of mounting and removal of a lowest process cartridge of the plurality of process cartridges.

6. The image formation device of claim 1, wherein the guide portion is a fixed horizontal guide portion.

7. The image forming device of claim 1, wherein when the cover body opens up the lateral direction side of the process cartridges, each process cartridge is capable of being extracted in the horizontal direction until the trailing end side of the process cartridge in an extraction direction is substantially disengaged from the device main body.

8. An image formation device comprising:

a device main body;

a plurality of process cartridges, which are arranged in tandem in a vertical direction and which are each provided at a device main body to be removable by being drawn out in a horizontal direction;

a paper supply portion provided downward of the plurality of process cartridges;

a belt body disposed near side portions of the plurality of process cartridges; and a roller which is provided on the belt body and urges, toward the belt body, paper which has been fed to the belt body from the paper supply portion;

a cover body which covers the side portions of the plurality of process cartridges and is axially supported at a position below a supply tray of the paper supply portion, from which paper is conveyed, and is swingable, wherein the belt body is mounted at the cover body so as to be disposed between the plurality of process cartridges and the cover body, and the belt body swings integrally with the cover body, wherein, when the cover body opens up the lateral direction side of the process cartridges, the belt body is removed from a path of mounting and removal of a lowest process cartridge of the plurality of process cartridges, and a fixed horizontal guide portion at which a lowest process cartridge of the plurality of process cartridges is placed guides the lowest process cartridge to a mounting operation position in the device main body.

9. The image formation device of claim 8, wherein a paper supply cassette is mountably and removably provided at the paper supply portion.

10. The image formation device of claim 9, wherein an opening portion through which the paper supply cassette can be passed is formed at the cover body, and a lower end of the belt body is disposed upward of the opening portion.

11. The image formation device of claim 8, wherein the guide portion at which a lowest process cartridge of the plurality of process cartridges can be placed, the guide portion guiding the process cartridge that has been placed thereat to a mounting position in the device main body.

12. The image formation device of claim 11, wherein the guide portion is formed at an upper face of the paper supply portion.

13. The image formation device of claim 8, wherein the belt body comprises a transport belt which electrostatically attracts and transports paper, a charging roller which electrostatically charges the transport belt is provided at the belt body, and the charging roller is capable of moving out from a path of mounting and removal of a lowest process cartridge of the plurality of process cartridges when the cover body swings.

14. The image forming device of claim 8, wherein when the cover body opens up the lateral direction side of the process cartridges, each process cartridge is capable of being extracted in the horizontal direction until the trailing end side of the process cartridge in an extraction direction is substantially disengaged from the device main body.

15. An image formation device comprising:

a device main body;

a plurality of process cartridges, which are arranged in tandem in a vertical direction and which are each provided at a device main body to be removable by being drawn out in a horizontal direction;

a paper supply portion provided downward of the plurality of process cartridges;

a belt body disposed near side portions of the plurality of process cartridges, the belt body transporting paper between the belt body and each of the plurality of process cartridges;

a roller which is provided on the belt body and urges, toward the belt body, paper which has been fed to the belt body from the paper supply portion; and a cover body which covers the side portions of the plurality of process cartridges, wherein the cover body is axially supported at a position below a supply tray of the paper supply portion, from which paper is conveyed, and is swingable, for opening and closing a side of the device main body at the side portions, the belt body is mounted at the cover body so as to be disposed between the plurality of process cartridges and the cover body, and the belt body operates to open and close integrally with the cover body;

wherein, when the cover body opens up the lateral direction side of the process cartridges, the belt body is removed from a path of mounting and removal of a lowest process cartridge of the plurality of process cartridges, and a fixed horizontal guide portion at which a lowest process cartridge of the plurality of process cartridges is placed guides the lowest process cartridge to a mounting operation position in the, device main body.

16. The image formation device of claim 15, wherein the guide portion is formed at an upper face of the paper supply portion, at which guide portion a lowest process cartridge of the plurality of process cartridges can be placed, the guide portion guiding the process cartridge that has been placed thereat to a mounting position in the device main body.

17. The image forming device of claim 15, wherein when the cover body opens up the lateral direction side of the process cartridges, each process cartridge is capable of being extracted in the horizontal direction until the trailing end side of the process cartridge in an extraction direction is substantially disengaged from the device main body.

* * * * *